US009752492B2

(12) United States Patent
Sheidler

(10) Patent No.: US 9,752,492 B2
(45) Date of Patent: Sep. 5, 2017

(54) FAN CONTROL SYSTEM AND METHOD

(71) Applicant: Deere & Company, Moline, IL (US)

(72) Inventor: Alan D. Sheidler, Moline, IL (US)

(73) Assignee: DEERE & COMPANY, Moline, IL (US)

( * ) Notice: Subject to any disclaimer, the term of this patent is extended or adjusted under 35 U.S.C. 154(b) by 244 days.

(21) Appl. No.: 14/640,539

(22) Filed: Mar. 6, 2015

(65) Prior Publication Data

US 2016/0258338 A1 Sep. 8, 2016

(51) Int. Cl.
*F01P 7/02* (2006.01)
*G05D 23/00* (2006.01)
*F01P 7/04* (2006.01)

(52) U.S. Cl.
CPC ..... *F01P 7/04* (2013.01); *F01P 2023/08* (2013.01)

(58) Field of Classification Search
CPC ..... F01P 11/14; F01P 2023/08; F01P 7/04
USPC ..... 123/41.01, 41.11, 41.12, 41.39
See application file for complete search history.

(56) References Cited

U.S. PATENT DOCUMENTS 4,257,554 A * 3/1981 Willingham ..... F01P 5/04 123/41.12
6,240,774 B1 * 6/2001 Niki ..... F01P 11/14 123/41.01
6,497,201 B1 * 12/2002 Werson ..... F04D 13/06 123/41.12
6,772,714 B2 * 8/2004 Laird ..... F01P 7/042 123/41.12
6,996,441 B1 * 2/2006 Tobias ..... G05D 23/1919 165/104.33
7,134,406 B1 11/2006 Loes
7,310,959 B2 12/2007 Braun et al.
7,863,839 B2 1/2011 Schuricht et al.
7,945,378 B2 5/2011 Sheidler et al.
8,522,700 B2 9/2013 Landphair
8,589,049 B2 11/2013 Craig
8,596,194 B2 12/2013 Kraus
8,725,361 B2 5/2014 Kellum
8,726,543 B2 5/2014 Kelly
2004/0011304 A1 * 1/2004 Herynek ..... F01P 7/164 123/41.1
2006/0191500 A1 * 8/2006 Sugiyama ..... F01P 7/048 123/41.12
2007/0261648 A1 * 11/2007 Reckels ..... F01P 7/167 123/41.12
2007/0272173 A1 * 11/2007 Reckels ..... F01P 7/167 123/41.11
2008/0216777 A1 * 9/2008 Vetrovec ..... F01P 11/20 123/41.29
2009/0062963 A1 3/2009 Hayashi
2010/0083916 A1 * 4/2010 Shintani ..... F01P 7/164 123/41.1

(Continued)

*Primary Examiner* — Tea Holbrook

(57) ABSTRACT

A method for controlling a fan. The method includes determining an actual air flow over an engine of a vehicle at a current time, and determining a necessary air flow over the engine for maintaining an appropriate engine coolant temperature. The actual air flow is associated with the vehicle traveling in a first direction. The method further includes estimating a future air flow over the engine that is associated with the vehicle travelling in a second direction. The method also includes controlling a fan operating characteristic based on the actual, necessary, and future air flows.

19 Claims, 4 Drawing Sheets

(56) References Cited

U.S. PATENT DOCUMENTS

| | | | | |
|---|---|---|---|---|
| 2010/0305821 | A1* | 12/2010 | Huseman | B60L 7/18 701/54 |
| 2011/0166711 | A1* | 7/2011 | Markowitz | B60H 1/00735 700/278 |
| 2012/0061069 | A1 | 3/2012 | Schwartz | |
| 2012/0097118 | A1* | 4/2012 | Malmgren | F01P 7/026 123/41.12 |
| 2012/0304944 | A1* | 12/2012 | Nelson | F01P 11/06 123/41.12 |
| 2014/0109846 | A1* | 4/2014 | Styles | F01P 7/08 123/41.12 |
| 2014/0121931 | A1 | 5/2014 | Kellum | |
| 2014/0195106 | A1* | 7/2014 | McQuade | G07C 5/0841 701/33.9 |
| 2014/0224468 | A1 | 8/2014 | Saito | |
| 2015/0274030 | A1* | 10/2015 | Payne | B60L 11/1874 701/22 |
| 2015/0345370 | A1* | 12/2015 | Biagini | F01P 11/14 105/62.1 |
| 2016/0115856 | A1* | 4/2016 | Ge | F01P 7/04 415/1 |

* cited by examiner

FAN CONTROL SYSTEM AND METHOD

FIELD OF THE DISCLOSURE

The present disclosure relates to a system and method for controlling a fan.

BACKGROUND OF THE DISCLOSURE

Vehicles powered by internal combustion engines may be cooled by a coolant system, having coolant circulating in jackets surrounding combustion cylinders. The coolant may be heated by the engine and then cooled for recirculation by a heat exchanger, and the heat exchanger may be cooled by an air flow enhanced by a fan. The fan may be driven by an engine crankshaft, electrically driven by a vehicle electric system, or driven by a hydraulic system.

Some known methods for controlling a fan speed use coolant temperature signals for regulating, for example, a fan speed or blade pitch. For example, such a method my increase the fan speed or the blade pitch, as the coolant temperature increases and vice-versa. Such methods are reactive, rather than proactive.

In some operating conditions, the vehicle may operate in windy conditions. And during such conditions, if the vehicle is a work machine, for example, the vehicle may drive into the wind on one pass and drive with the wind on the next pass. When the vehicle drives into the wind, the fan and cooling system may provide adequate cooling and lower the coolant temperature. But when the vehicle drives with the wind, the fan and the cooling system may place a large load on engine and/or struggle to maintain reasonable coolant temperatures.

SUMMARY OF THE DISCLOSURE

Disclosed is a method for controlling a fan. The method includes determining an actual air flow over an engine of a vehicle at a current time, and determining a necessary air flow over the engine for maintaining an appropriate engine coolant temperature. The actual air flow is associated with the vehicle traveling in a first direction. The method further includes estimating a future air flow over the engine that is associated with the vehicle travelling in a second direction. Further, the method includes controlling a fan operating characteristic based on the actual, necessary, and future air flows.

BRIEF DESCRIPTION OF THE DRAWINGS

The detailed description of the drawings refers to the accompanying figures in which.

DETAILED DESCRIPTION OF THE DRAWINGS

Figure 1:
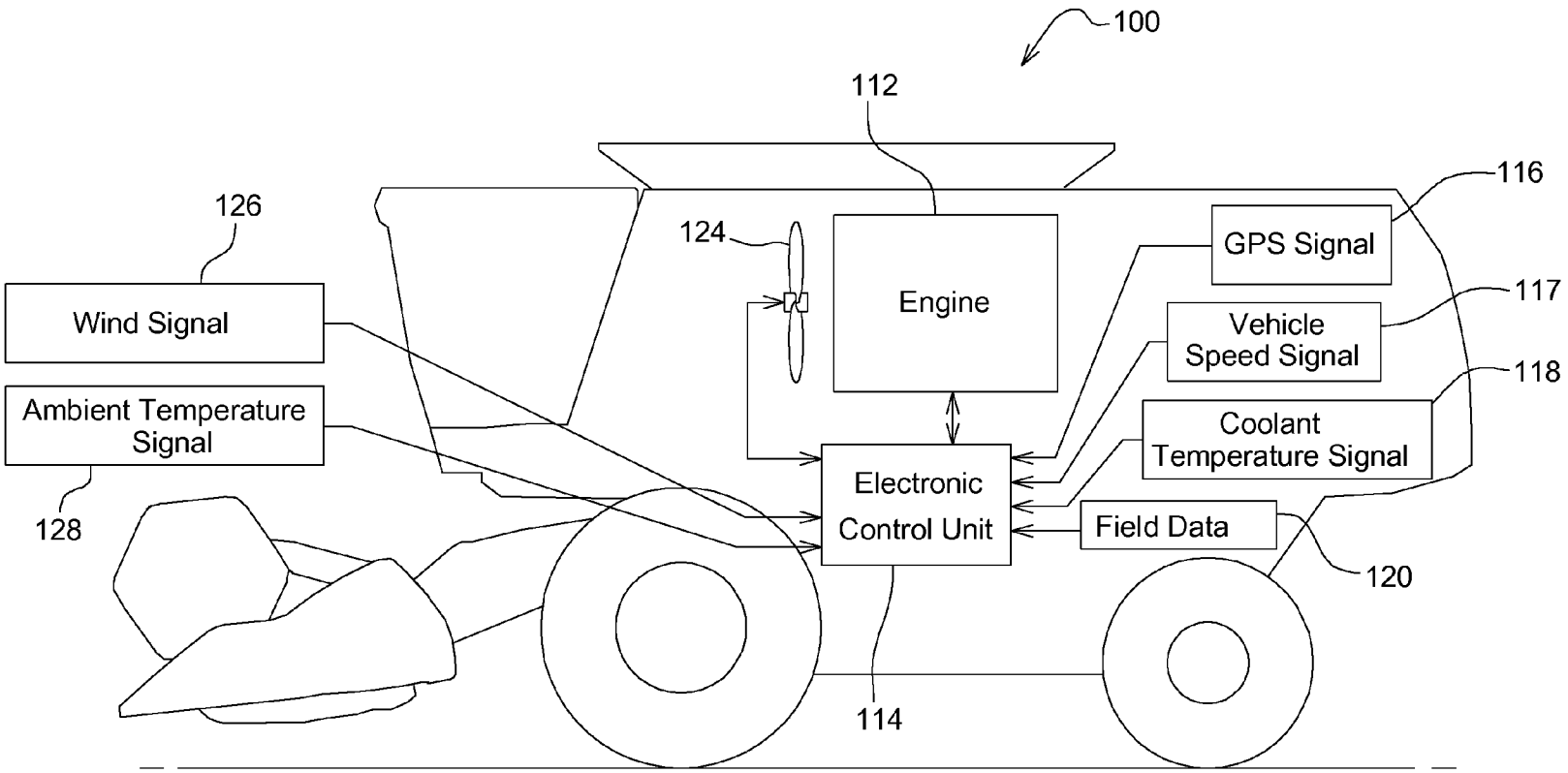
FIG. 1 is a diagrammatic view of an example vehicle and fan control system.

Referring to FIG. 1, there is shown a schematic illustration of an example vehicle 100. The vehicle 100 is shown in the form of an agricultural combine, though it may be any kind of on-highway or off-highway vehicle. Exemplarily, off-highway vehicles may be in the form of agricultural tractors, construction machines, and recreational vehicles. The vehicle 100 includes an engine 112, which may be a gasoline engine, a diesel engine, a natural gas engine, or any other combustion engine. It may be of any size, have any number of cylinders, and be of various configurations. In some embodiments, the engine 112 may also be in the form of an electric motor.

An electronic control unit ("ECU") 114 may be coupled to the engine 112 and may use real time signal inputs from sensor and pre-programmed performance models to deliver peak fuel economy, engine performance, and emissions characteristics. The ECU 114 is just one embodiment of a controller, and in other cases, it may be a fan ECU or part of a controller area network, to name just a couple of examples.

As shown, the ECU 114 may receive a GPS signal 116. A GPS unit may provide the GPS signal 116, and it may receive information from sources, such as one or both of a terrestrial source or an extraterrestrial source. The GPS signal 116 may correspond to one or more of the location, longitude, latitude, attitude, and altitude of the vehicle 100. In some embodiments, the GPS signal 116 may provide the vehicle speed signal 117 and/or a driving direction signal 125.

A fan 124 may be coupled to the engine 112, wherein its size and configuration depend on the application. The fan 124 may be a "pusher fan" or a "puller fan," and it may be hydraulically or mechanically driven, either of which could provide variable operating speeds. Exemplarily, the fan 124 may have blades that vary in pitch for adjusting the air flow provided at a given speed.

The ECU 114 may determine a vehicle speed based on the vehicle speed signal 117. As just one example, the ECU 114 may determine the vehicle speed based on how quickly gear teeth pass by a magnetic pickup in a drivetrain of the vehicle 100. By viewing the frequency thereof, the ECU 114 may then calculate how quickly the vehicle 100 is travelling.

Further, the ECU 114 may receive a field data 120 that may, among other things, indicate the boundaries of a work zone or field. The vehicle 100 may turn from a first direction to a second direction at the boundaries, and in such cases, the first direction may be opposite and parallel relative thereto. The ECU 114 may estimate the time at which the end turns will occur based on the direction and speed at which the vehicle 100 is travelling. As another example, in some instances, the ECU 114 may estimate the time at which the direction change will occur based on known future vehicle movements and locations. Vehicle control systems, such as John Deere's AutoTrac, may provide such information.

The ECU 114 may record data associated with where the vehicle 100 is operating. In the case of the vehicle 100, it may repeatedly go up one row in a first direction and then go down the next in a second direction. Recording the vehicle locations may be useful for predicting future vehicle locations, particularly when field data 120 is unavailable (e.g., when the field and its boundaries have never been mapped) and such locations are repetitive and systematic. For instance, if the vehicle 100 is systematically traveling in opposite, first and second directions, then the ECU 114 may extrapolate that information when predicting future vehicle directions and locations.

The ECU 114 may receive an engine coolant temperature signal 118, and from this, the ECU 114 may determine the engine coolant temperature associated with, for example, the temperature of the coolant as it is leaving the engine 112 and entering a heat exchanger. A temperature sensor may provide the coolant temperature signal 118.

The ECU 114 may receive a fan signal related to operating characteristics of the fan 124, such as the rotational speed and blade pitch thereof. The ECU 114 may also receive a wind signal 126 and an ambient temperature signal 128. An anemometer and a wind vane may provide the wind signal 126, and in such cases, the wind signal 126 may include a wind speed signal and a wind direction signal. A thermocouple may provide the temperature signal 128. In some instances, a satellite signal may provide the wind signal 126 and the temperature signal 128.

Figure 2:
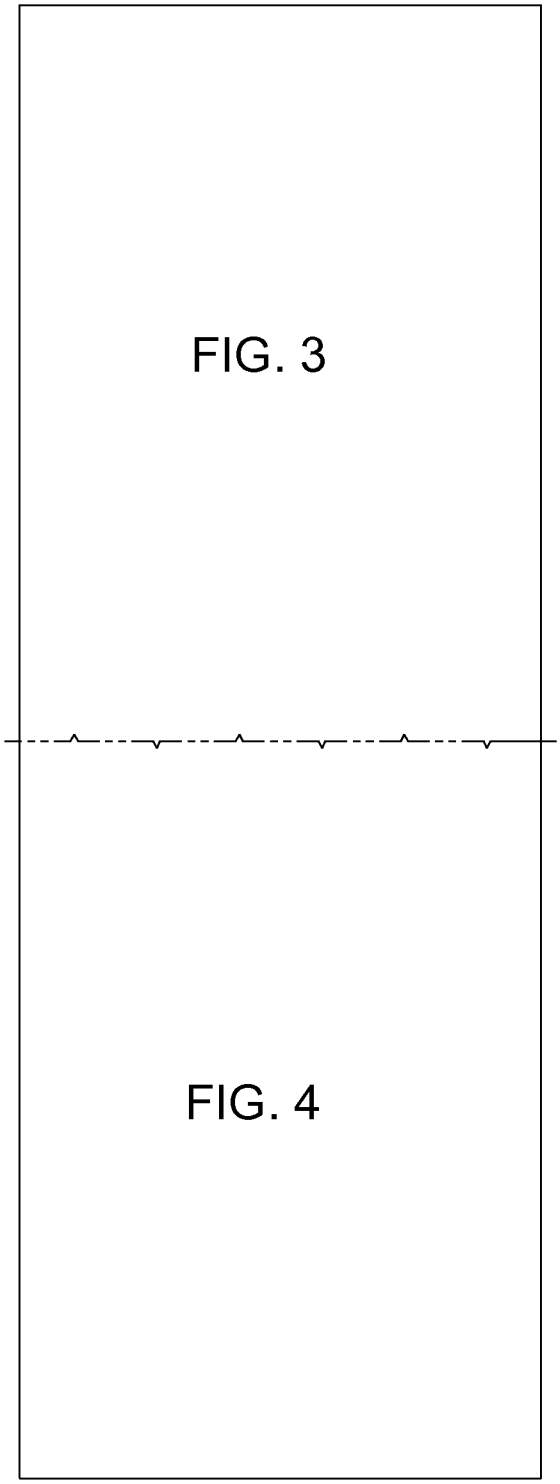
FIG. 2 illustrates a relationship between FIG. 3 and FIG. 4.
Figure 3:
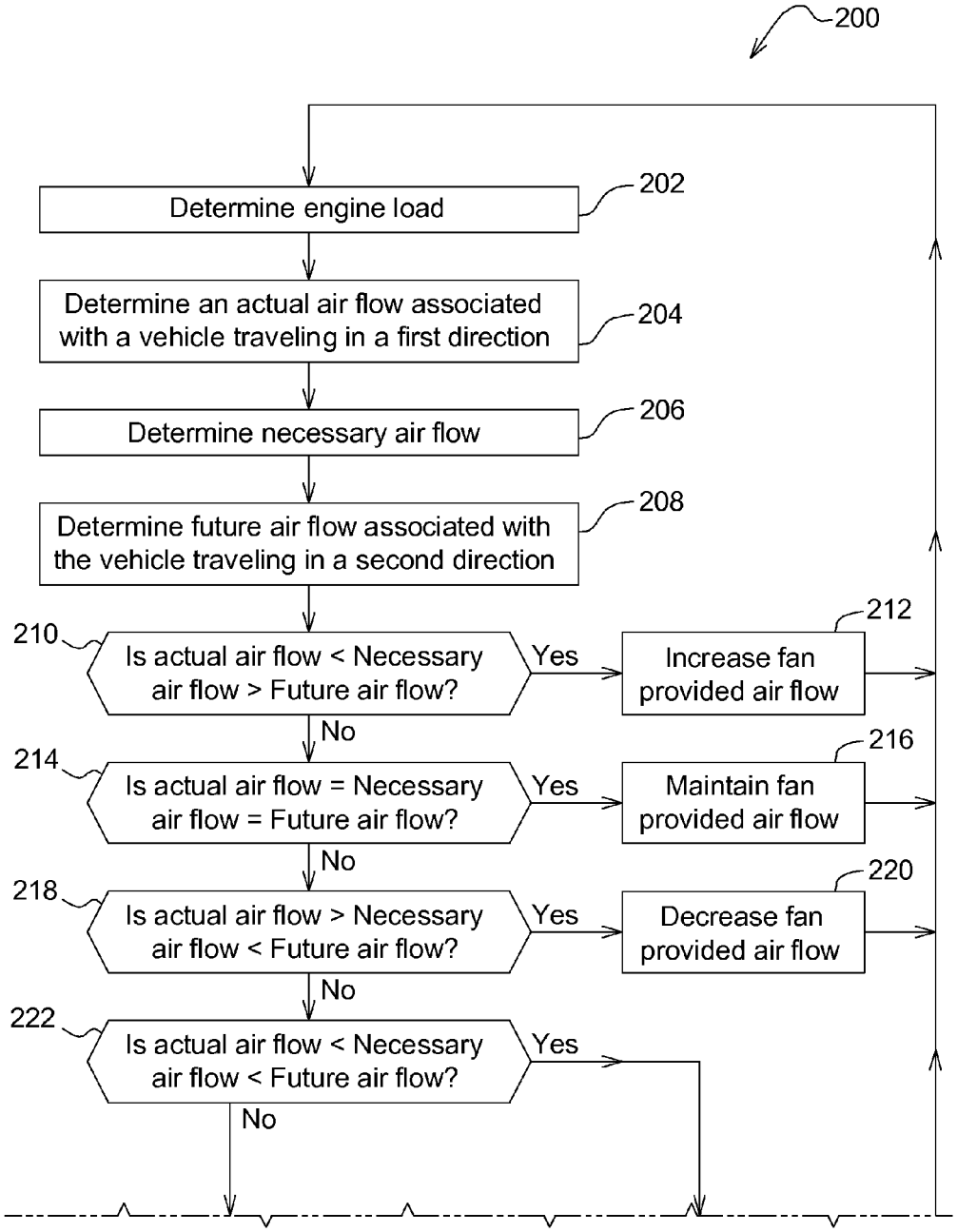
FIG. 3 is a flow chart of an example method for controlling a fan.
Figure 4:
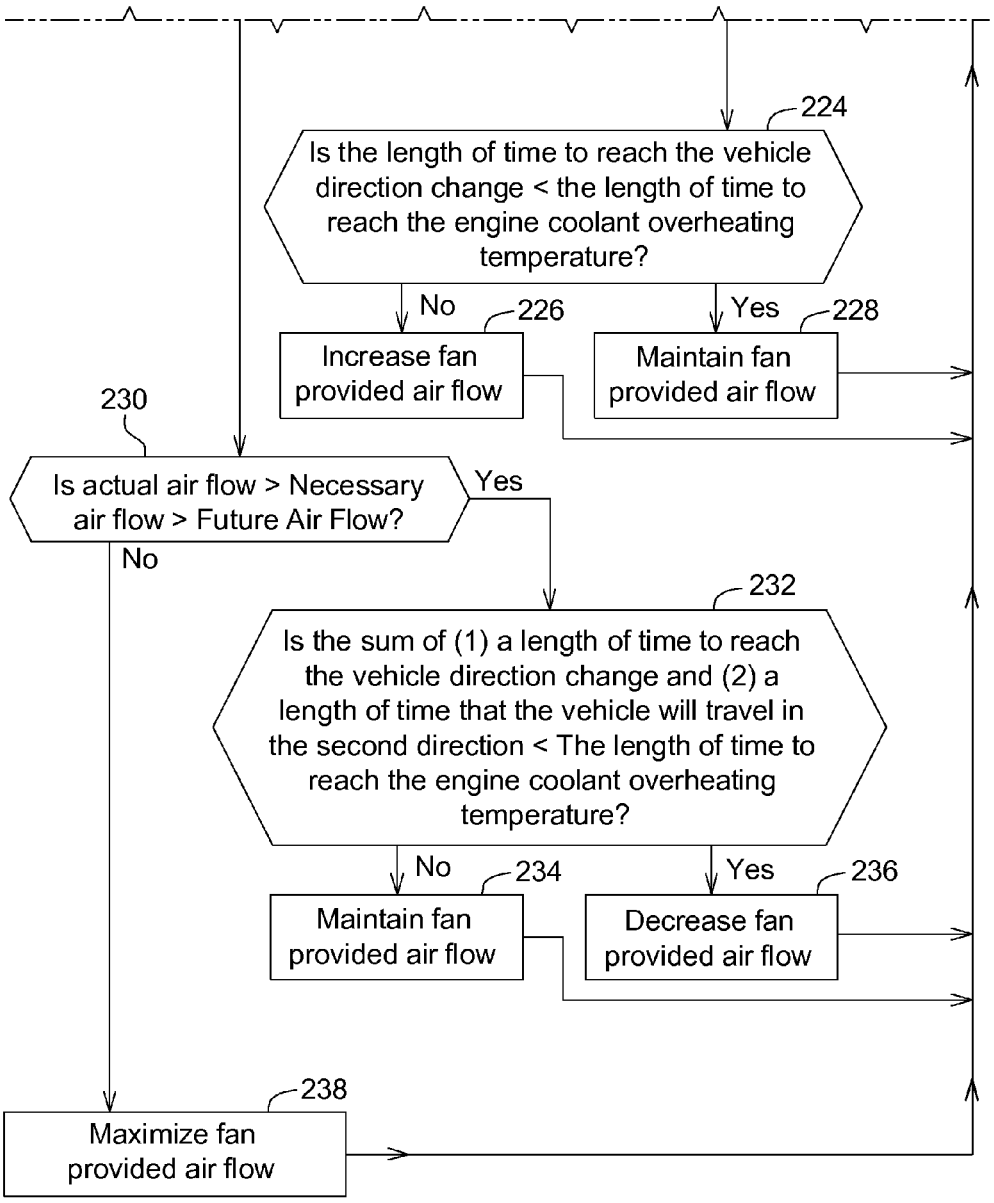
FIG. 4 is a remaining portion of the flow chart in FIG. 3.

Shown in FIG. 2 is the relationship between FIG. 3 and FIG. 4, FIG. 3 being a flow chart of an example method 200 and FIG. 4 being the remaining portion thereof. At step 202, the ECU 114 may determine the engine load 119 by, for example, computing a theoretical engine torque and multiplying it by the engine speed.

At step 204, the ECU 114 may determine an actual air flow over the engine 112 at a current time, the actual air flow being associated with the vehicle 100 traveling in a first direction. The actual air flow may be a sum of the fan provided air flow, a wind provided air flow, and a vehicle movement provided air flow (i.e., the air flow past the vehicle 100, as a result only of the movement thereof).

As just one example, in the first direction, the vehicle 100 may be traveling against a wind provided air flow, wherein the fan provided air flow, the wind provided air flow, and the vehicle movement provided air flow all complement one another to cool the engine 112. As an alternative example, if the vehicle is traveling in the first direction, but with the wind provided air flow, then the fan provided air flow may be countering the wind provided air flow and the vehicle movement provided air flow.

At step 206, the ECU 114 may determine a necessary air flow for keeping the engine 112 and its cooling system at reasonable, safe operating temperatures. The necessary air flow may be assumed to be independent of the direction of travel of the vehicle 100, and may depend more on engine loads and environmental temperatures.

At step 208, the ECU 114 may estimate a future air flow over the engine 112 that is associated with the vehicle 100 traveling in a second direction. When making this estimation, the ECU 114 may assume that the future fan provided air flow associated with the second direction is the same as a current fan provided air flow associated with the first direction. Whether this will actually occur depends on the final recommendation of method 200.

The first and second directions may be, for example, parallel and opposite to one another, angled, or any other direction relative to one another, depending on the path of the vehicle 100.

The ECU 114 may estimate the future vehicle locations and the future air flow. The future vehicle locations and direction changes may be based on the field data 120 or the vehicle control system, such as John Deere AutoTrac, for example. The future air flow may be based, in part, on the air flow in the first direction. For example, if the vehicle 100 is travelling against the wind in the first direction, then the ECU 114 may assume that the vehicle 100 will travel with the wind in the second direction. Additionally, if the wind speed is blowing at a certain speed when the vehicle is traveling in the first direction, then the ECU 114 may assume that the wind speed will be the same when the vehicle is traveling in the second direction. The ECU 114 may further assume that the relative direction of the wind relative to the vehicle 100 will change, the change being based on the direction change of the vehicle 100.

Steps 210, 214, 218, 222, and 230 compare the actual air flow to the necessary air flow and the future air flow. How these flows relate to one another determines how the method 200 proceeds.

At step 212, the ECU 114 may increase a fan provided air flow if, as determined at step 210, (1) the necessary air flow is greater than the actual air flow, and (2) the necessary air flow is greater than the future air flow. The air flow of the fan 124 may be increased by increasing the speed and/or blade pitch thereof. An increase in the fan provided air flow may be needed to keep the engine 112 and cooling system at a reasonable, safe operating temperature. In some modes, the air flow may need to be maintained due to the fan 124 already providing a maximum air flow, as a result of mechanical or electrical limits, for example.

At step 216, the ECU 114 may maintain the fan provided air flow if, as determined at step 212, (1) the necessary air flow equals the actual air flow, and (2) the necessary air flow equals the future air flow. The fan provided air flow is maintained, as a result of it already providing the correct flow (e.g., the necessary air flow) for keeping the engine 112 at a reasonable operating temperature. In some embodiments of the method 200, the different flows may be considered equal if they are substantially close to one another (e.g., within 10% of one another).

At step 220, the ECU 114 may decrease the fan provided air flow if, as determined at step 218, both (1) the actual air flow is greater than the necessary air flow, and (2) the future air flow is greater than the necessary air flow. In some modes, the air flow may be maintained due to the fan 124 already providing a minimum air flow, as a result of mechanical or electrical limits, for example. In some other modes, the air flow of the fan 124 may be decreased by decreasing the speed and/or blade pitch thereof. Decreasing the fan speed and/or blade pitch may decrease the load on the engine 112, and allow the engine 112 to provide power to other applications and improve its fuel economy.

At step 228, the ECU 114 may maintain the fan provided air flow if, as determined at steps 222 and 224, the (1) necessary air flow is greater than the actual air flow, (2) the future air flow is greater than the necessary air flow, and (3) a length of time to reach a vehicle direction change, from the first direction to the second direction, is less than a length of time to reach an engine coolant overheating temperature. The engine coolant overheating temperature is a temperature that is too high for the engine 112 to consistently operate without damage thereto or to surrounding components.

At step 228, the ECU 114 may determine a rate at which an engine coolant temperature will rise when the vehicle is traveling in the first direction, and basing the length of time to reach the engine coolant overheating temperature thereon. By maintaining the fan provided air flow at step 228, the load associated with the fan 124 is maintained, instead of increased, and the cooling effect associated with the second direction, and wind direction, is leveraged.

For calculation purposes at step 228, the length of time to reach the engine coolant overheating temperature may be based on the assumption that the vehicle will continue in the first direction until the engine coolant overheats, even though it may change directions prior to this actually occurring (i.e., the length of time is theoretical and never actually reached). Further, for calculation purposes at step 228, the actual air flow and the future air flow may be based on the assumption the fan provided air flow is consistent therebetween. Whether the fan provided air flow is really consistent is based on the outcome of the recommendation in method 200 for leveraging the wind, minimizing the load associated with the fan 124, and meeting the cooling needs associated with the engine 112.

At step 226, the ECU 114 may increase the fan provided air flow if, as determined at steps 222 and 224, (1) the necessary air flow is greater than the actual air flow, (2) the future air flow is greater than the necessary air flow, (3) a length of time to reach a vehicle direction change, from the first direction to the second direction, is greater than the length of time to reach an engine coolant overheating temperature. As part of step 226, the ECU 114 may determine a rate at which the engine coolant temperature will rise in the first direction, and base the length of time to reach the engine coolant overheating temperature thereon.

By increasing the fan provided air flow at step 226, the engine 112 is cooled and protected from thermal damage. This increase in the first direction may be necessary, because the vehicle 100 may not reach the second direction, which leverages the wind, until after the engine 112 (and engine coolant) reaches too high of a temperature. In some modes, at step 226, the air flow may need to be maintained due to the fan 124 already providing a maximum air flow, as a result of mechanical or electrical limits, for example.

At step 236, the ECU 114 may decrease the fan provided air flow if, as determined at steps 230 and 232, the (1) the actual air flow is greater than the necessary air flow, (2) the necessary air flow is greater than the future air flow, and (3) a sum of a length of time to reach a vehicle direction change, from the first direction to the second direction, and a length of time that the vehicle 100 will be in the second direction is less than a length of time to reach an engine coolant overheating temperature.

By decreasing the fan provided air flow at step 236, the engine 112 leverages the currently favorable wind flows in the first direction, but then allows the engine coolant to warm up during the second direction. And even though the engine 112 will warm up in the second direction, it will not warm up so quickly as to cause damage to the engine 112 prior to the vehicle returning back to the first direction of operation, which leverages the wind flow. In such a case, the length of time to reach an engine coolant overheating temperature is a theoretical time only. This is a result of an estimate that the vehicle 100 will not, in reality, be in the second direction long enough to reach such high temperatures.

In some modes, in step 236, the air flow may be maintained due to the fan 124 already providing a minimum air flow, as a result of mechanical or electrical limits, for example. In some other modes, the air flow of the fan 124 may be decreased by decreasing the speed and/or blade pitch thereof. Decreasing the fan speed and/or blade pitch may decrease the load on the engine 112, and allow the engine 112 to provide power to other applications and improve its fuel economy.

At step 234, the ECU 114 may maintain or increase the fan provided air flow if, as determined at steps 230 and 232, the (1) the actual air flow is greater than the necessary air flow, (2) the necessary air flow is greater than the future air flow, and (3) a sum of a length of time to reach a vehicle direction change, from the first direction to the second direction, and a length of time that the vehicle 100 is in the second direction is greater than a length of time to reach an engine coolant overheating temperature.

At step 234, the ECU 114 may include determining a rate at which an engine coolant temperature will fall before the vehicle direction change from the first direction to the second direction, and a rate at which an engine coolant temperature will rise when the vehicle is in the second direction. From that, the ECU 114 may base the length of time to reach the engine coolant overheating temperature on the rate at which the engine coolant temperature will fall and rise.

Further, at step 234, the ECU 114 may maintain the fan provided air flow and then increase it at a later time (e.g., in the second direction), or the ECU 114 may immediately increase the fan provided air flow. Whether to maintain or increase the fan provided air flow immediately, at step 234, depends on the cooling needs of the engine 112 without respect to engine loads and the environmental conditions.

If none of the conditions at steps 210, 214, 218, 222, or 230 are true, then the ECU 114, at step 238, may maximize the fan provide air flow. In case there are signal or determination issues, then step 238 serves to protect the engine 112 by maximizing the air flow until any issues are resolved.

In some embodiments of the method 200, when a decision is made to maintain, decrease, or increase a fan provided air flow, there may be a counting method implemented prior to actual maintaining, decreasing, or increasing the fan provided air flow, respectively. For example, the method 200 may go through its routine several times per second and count how many times it recommends a certain action. It may do this for several seconds, so as to make sure that it is making a consistent recommendation. Once there is a consistent recommendation, then the ECU 114 will actually implement the recommendation and send a signal to the fan 124.

While the disclosure has been illustrated and described in detail in the drawings and foregoing description, such illustration and description is to be considered as exemplary and not restrictive in character, it being understood that illustrative embodiments have been shown and described and that all changes and modifications that come within the spirit of the disclosure are desired to be protected. It will be noted that alternative embodiments of the present disclosure may not include all of the features described yet still benefit from at least some of the advantages of such features. Those of ordinary skill in the art may readily devise their own implementations that incorporate one or more of the features of the present disclosure and fall within the spirit and scope of the present invention as defined by the appended claims.

The invention claimed is:

1. A method for controlling a fan, the method comprising:
determining an actual air flow over an engine of a vehicle at a current time, the actual air flow being associated with the vehicle traveling in a first direction;
determining a necessary air flow over the engine for maintaining an appropriate engine coolant temperature;
estimating a future air flow over the engine, the future air flow being associated with the vehicle travelling in a second direction; and
controlling a fan operating characteristic based on the actual air flow, the necessary air flow, and the future air flow, and wherein the controlling comprises maintaining a fan provided air flow if:
the necessary air flow is greater than the actual air flow;
the future air flow is greater than the necessary air flow; and
a length of time to reach a vehicle direction change, from the first direction to the second direction, is less than a length of time to reach an engine coolant overheating temperature.

2. The method of claim 1, wherein the estimating the future air flow comprises assuming that a future fan provided air flow associated with the second direction is the same as a current fan provided air flow associated with the first direction.

3. The method of claim 1, wherein the first direction and the second direction are opposite directions relative to one another and parallel relative to one another.

4. The method of claim 1, wherein the first direction and the second direction are opposite direction relative to one another and overlapping one another.

5. The method of claim 1, wherein the controlling comprises increasing a fan provided air flow if:

the necessary air flow is greater than the actual air flow; and the necessary air flow is greater than the future air flow.

6. The method of claim 1, wherein the controlling comprises maintaining a fan provided air flow if:

the necessary air flow equals the actual air flow; and the necessary air flow equals the future air flow.

7. The method of claim 1, wherein the controlling comprises decreasing a fan provided air flow if:

the actual air flow is greater than the necessary air flow; and the future air flow is greater than the necessary air flow.

8. The method of claim 1, further comprising:

receiving a wind signal; and estimating the future air flow based on the wind signal and the second direction.

9. The method of claim 8, wherein the wind signal comprises a wind speed signal and a wind direction signal.

10. The method of claim 1, further comprising:

determining a rate at which an engine coolant temperature will rise; and basing the length of time to reach the engine coolant overheating temperature on the rate at which the engine coolant temperature will rise.

11. The method of claim 1, further comprising basing the length of time to reach the engine coolant overheating temperature on the length of time to reach the vehicle direction change from the first direction to the second direction.

12. The method of claim 1, wherein the controlling comprises increasing the fan provided air flow if:

the necessary air flow is greater than the actual air flow;

the future air flow is greater than the necessary air flow; and the length of time to reach the vehicle direction change, from the first direction to the second direction, is greater than the length of time to reach the engine coolant overheating temperature.

13. The method of claim 12, further comprising:

determining a rate at which an engine coolant temperature will rise; and basing the length of time to reach the engine coolant overheating temperature on the rate at which the engine coolant temperature will rise.

14. The method of claim 1, wherein the controlling comprises decreasing the fan provided air flow if:

the actual air flow is greater than the necessary air flow;

the necessary air flow is greater than the future air flow; and a sum of the length of time to reach the vehicle direction change, from the first direction to the second direction, and a length of time that the vehicle will be in the second direction is less than the length of time to reach the engine coolant overheating temperature.

15. The method of claim 14, further comprising:

determining a rate at which an engine coolant temperature will fall before the vehicle direction change from the first direction to the second direction; and basing the length of time to reach the engine coolant overheating temperature on the rate at which the engine coolant temperature will fall.

16. The method of claim 14, further comprising basing the length of time to reach the engine coolant overheating temperature on the length of time the vehicle is in the second direction.

17. The method of claim 1, wherein the controlling comprises maintaining the fan provided air flow if:

the actual air flow is greater than the necessary air flow;

the necessary air flow is greater than the future air flow; and a sum of the length of time to reach the vehicle direction change, from the first direction to the second direction, and a length of time that the vehicle is in the second direction is greater than the length of time to reach the engine coolant overheating temperature.

18. The method of claim 17, further comprising:

determining a rate at which an engine coolant temperature will fall before the vehicle direction change from the first direction to the second direction;

determining a rate at which the engine coolant temperature will rise in the second direction; and basing the length of time to reach the engine coolant overheating temperature on the rate at which the engine coolant temperature will fall and the rate at which the engine coolant temperature will rise.

19. A method for controlling a fan, the method comprising:

determining an actual air flow over an engine of a vehicle at a current time, the actual air flow being associated with the vehicle traveling in a first direction;

determining a necessary air flow over the engine for maintaining an appropriate engine coolant temperature;

estimating a future air flow over the engine, the future air flow being associated with the vehicle travelling in a second direction; and controlling a fan operating characteristic based on the actual air flow, the necessary air flow, and the future air flow, and wherein the controlling comprises maintaining a fan provided air flow if:

the actual air flow is greater than the necessary air flow;

the necessary air flow is greater than the future air flow; and a sum of a length of time to reach a vehicle direction change, from the first direction to the second direction, and a length of time that the vehicle is in the second direction is greater than a length of time to reach an engine coolant overheating temperature.

* * * * *